US007794331B2

(12) United States Patent
Tsai et al.

(10) Patent No.: US 7,794,331 B2
(45) **Date of Patent: *Sep. 14, 2010**

(54) GOLF CLUB INTERCHANGING CONNECTION STRUCTURE (III)

(75) Inventors: Liang-Ho Tsai, Kaohsiung (TW); Cheng-Tao Lee, Kaohsiung (TW)

(73) Assignee: Advanced International Multitech Co., Ltd, Kaohsiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/062,047

(22) Filed: Apr. 3, 2008

(65) Prior Publication Data

US 2009/0197697 A1 Aug. 6, 2009

(30) Foreign Application Priority Data

Feb. 5, 2008 (TW) ..... 97202590 U

(51) Int. Cl.
*A63B 53/02* (2006.01)

(52) U.S. Cl. ..... 473/288; 473/307; 473/309

(58) Field of Classification Search ..... 473/288, 473/296, 298–299, 306–308, 312, 309
See application file for complete search history.

(56) References Cited

U.S. PATENT DOCUMENTS 2,219,670 A * 10/1940 Wettlaufer ..... 473/247
5,513,844 A * 5/1996 Ashcraft et al. ..... 473/288
5,540,435 A * 7/1996 Kawasaki ..... 473/309
5,951,411 A * 9/1999 Wood et al. ..... 473/307
7,083,529 B2 8/2006 Cackett et al.
7,344,449 B2 * 3/2008 Hocknell et al. ..... 473/307
7,566,279 B2 * 7/2009 Nakashima ..... 473/288
2002/0037773 A1 * 3/2002 Wood et al. ..... 473/246
2008/0280693 A1 * 11/2008 Chai ..... 473/288
2009/0075749 A1 * 3/2009 Cruz et al. ..... 473/306
2009/0264214 A1 * 10/2009 De La Cruz et al. ..... 473/307

FOREIGN PATENT DOCUMENTS

JP 2000237355 A * 9/2000

* cited by examiner

*Primary Examiner*—Stephen L. Blau
(74) *Attorney, Agent, or Firm*—Morris, Manning & Martin LLP; Tim Tingkang Xia

(57) ABSTRACT

A golf club interchanging connection structure for interchanging a club head and a shaft includes a positioning mechanism, a club sleeve, an internal screw, and an anti-rotation external screw. The positioning mechanism is placed within the club head. The club sleeve, having one end being connected to and fixed with the shaft and the other end having a first male screw, is placed within the positioning mechanism. The internal screw comprises a nut hole, which is screwed with the first male screw of the club sleeve to lock the shaft connected to the club sleeve. The anti-rotation external screw comprises a second male screw on an outer surface thereof corresponding to a female screw in the club head, in which the second male screw of the anti-rotation external screw is screwed with the female screw, and the anti-rotation external screw leans against the internal screw.

2 Claims, 5 Drawing Sheets

GOLF CLUB INTERCHANGING CONNECTION STRUCTURE (III)

This application claims the benefit of Taiwan Patent Application No. 097202590, filed on Feb. 5, 2008, which is hereby incorporated by reference for all purposes as if fully set forth herein.

BACKGROUND OF THE INVENTION

1. Field of the Invention

The present invention relates to a golf club interchanging connection structure, and more particularly to an interchanging connection structure for interchanging a club head and a shaft of a golf club.

2. Related Art

As the golf sport develops vigorously, the structure and material of the golf club have also developed accordingly. In order to cater to each golfer, and to enable the golfer to select a suitable combination of a club head and a shaft according to the specific state during striking, golf-club manufacturers exert their efforts in developing a golf club with a quick head-shaft interchanging function.

Referring to FIG. 1, it is a schematic view of a conventional golf club interchanging connection structure. In U.S. Pat. No. 7,083,529, a golf club 10 with a quick interchanging function is proposed, which includes a club head 12 and a shaft 14, and the club head 12 and the shaft 14 are interchanged quickly through an interchanging connection structure 16. The interchanging connection structure 16 includes a club sleeve 18, a tube seat 20, and a screw 22. One end of the club sleeve 18 has an opening 24, the shaft 14 is placed into the opening 24 and bonded in the club sleeve 18. The tube seat 20 is embedded into the club head 12 and bonded in the club head 12. After the club sleeve 18 is placed into the tube seat 20, the screw 22 is used to lock the club sleeve 18 to the tube seat 20, so as to quickly interchange the club head 12 and the shaft 14.

However, the screw 22 will come loose easily after the golf club 10 has been utilized to hit the ball again and again, so as to influence the fixing effect of the club head 12 and the shaft 14 and the hitting performance. Probably, the club head 12 will depart from the shaft 14 due to the loose screw 22, so as to cause the risk of hurting people.

SUMMARY OF THE INVENTION

Accordingly, in order to solve the above problems, the present invention is directed to a golf club interchanging connection structure, in which an anti-rotation external screw is utilized to lean against an internal screw, which is helpful for preventing the internal screw from coming loose and then influencing the fixing effect of a club head and a shaft.

In order to achieve the objective, the present invention provides a golf club interchanging connection structure, which is applied for interchanging a club head and a shaft of a golf club. The golf club interchanging connection structure of the present invention includes a positioning mechanism, a club sleeve, an internal screw, and an anti-rotation external screw. The positioning mechanism is placed within the club head, and includes a flange therein. The club sleeve has one end being connected to and fixed with the shaft and the other end having a first male screw, and the club sleeve is placed within the positioning mechanism and leans against the flange. The internal screw comprises a nut hole, in which the end having the first male screw of the club sleeve is placed into the positioning mechanism, and the nut hole of the internal screw is screwed with the first male screw of the club sleeve to lock the shaft connected to the club sleeve. The anti-rotation external screw comprises a second male screw on an outer surface of the anti-rotation external screw corresponding to a female screw in the club head, in which the second male screw of the anti-rotation external screw is screwed with the female screw, and the anti-rotation external screw leans against the internal screw.

In order to achieve the above objective, the present invention further provides a golf club interchanging connection structure, which is applied for interchanging a club head and a shaft of a golf club. The golf club interchanging connection structure of the present invention includes a tube seat, a club sleeve, an internal screw, and an anti-rotation external screw. The tube seat is disposed in the club head, and comprises a flange, in which the flange includes a leaning surface and a positioning hole located in the leaning surface. The club sleeve is placed within the tube seat, and includes one end being connected to and fixed with the shaft and the other end having a nut hole. The internal screw comprises a screw head, in which the internal screw is positioned through the positioning hole and screwed with the nut hole of the club sleeve, and the screw head leans against the leaning surface to lock the shaft connected to the club sleeve. The anti-rotation external screw includes a first male screw on an outer surface thereof corresponding to a first female screw in the club head, in which the first male screw of the anti-rotation external screw is screwed with the first female screw, and the anti-rotation external screw leans against the screw head of the internal screw.

With the golf club interchanging connection structure of the present invention, the anti-rotation external screw is utilized to lean against the internal screw, which is helpful for preventing the internal screw from coming loose and then influencing the fixing effect of the club head and the shaft after the golf club has been utilized to hit the ball again and again. Furthermore, the golf club interchanging connection structure of the present invention prevents the club head from departing from the shaft due to the loose screw, so as to prevent the risk of hurting people.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

In order to make the objective, structure, and function of the present invention be more comprehensible, a detailed description is given below with reference to the embodiments and accompanying drawings.

Figure 1:
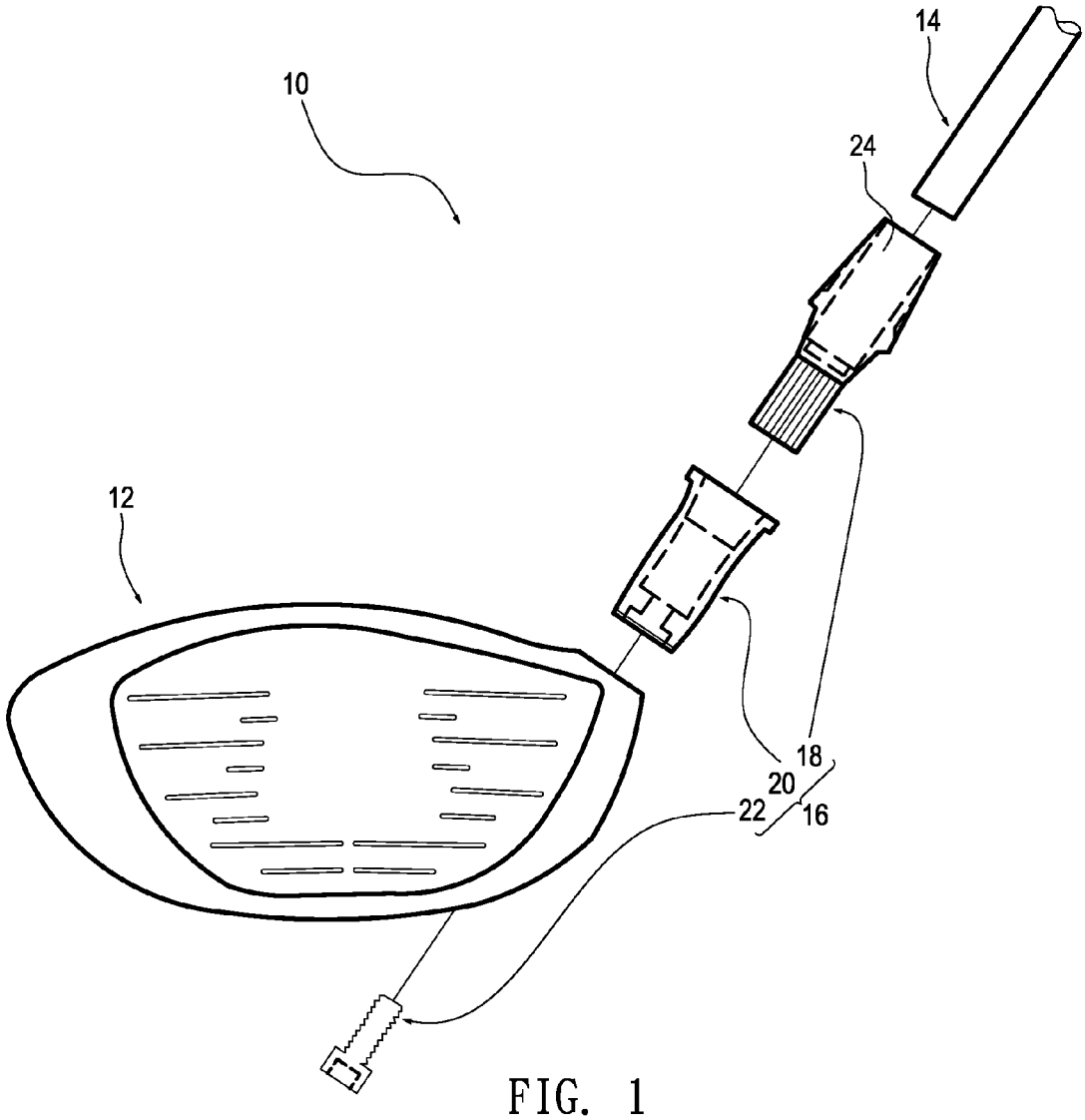
FIG. 1 (Conventional Art)
FIG. 1 is a schematic view of a conventional golf club interchanging connection structure.
Figure 2:
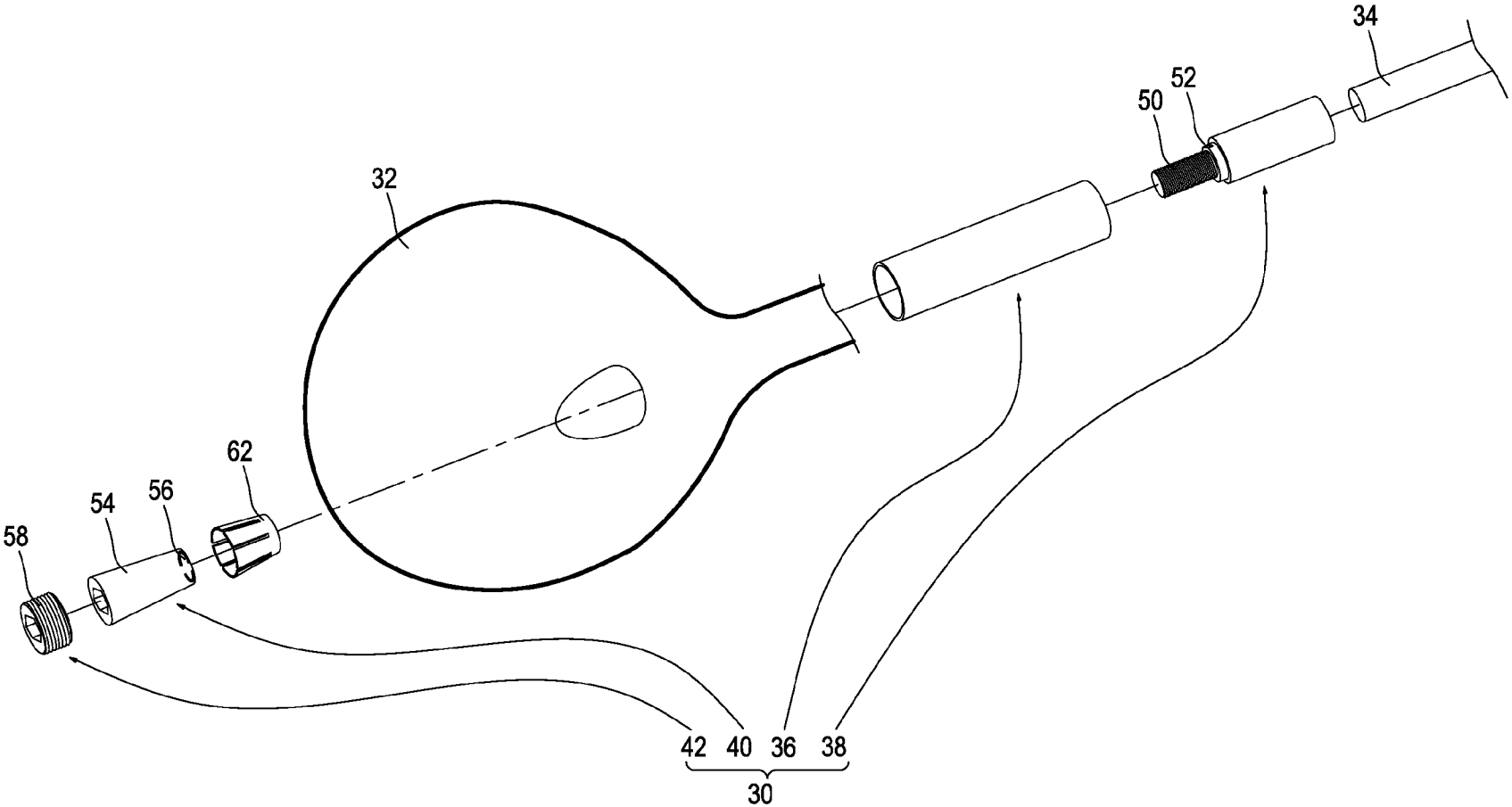
FIG. 2 is an exploded view of a golf club interchanging connection structure according to a first embodiment of the present invention.
Figure 3:
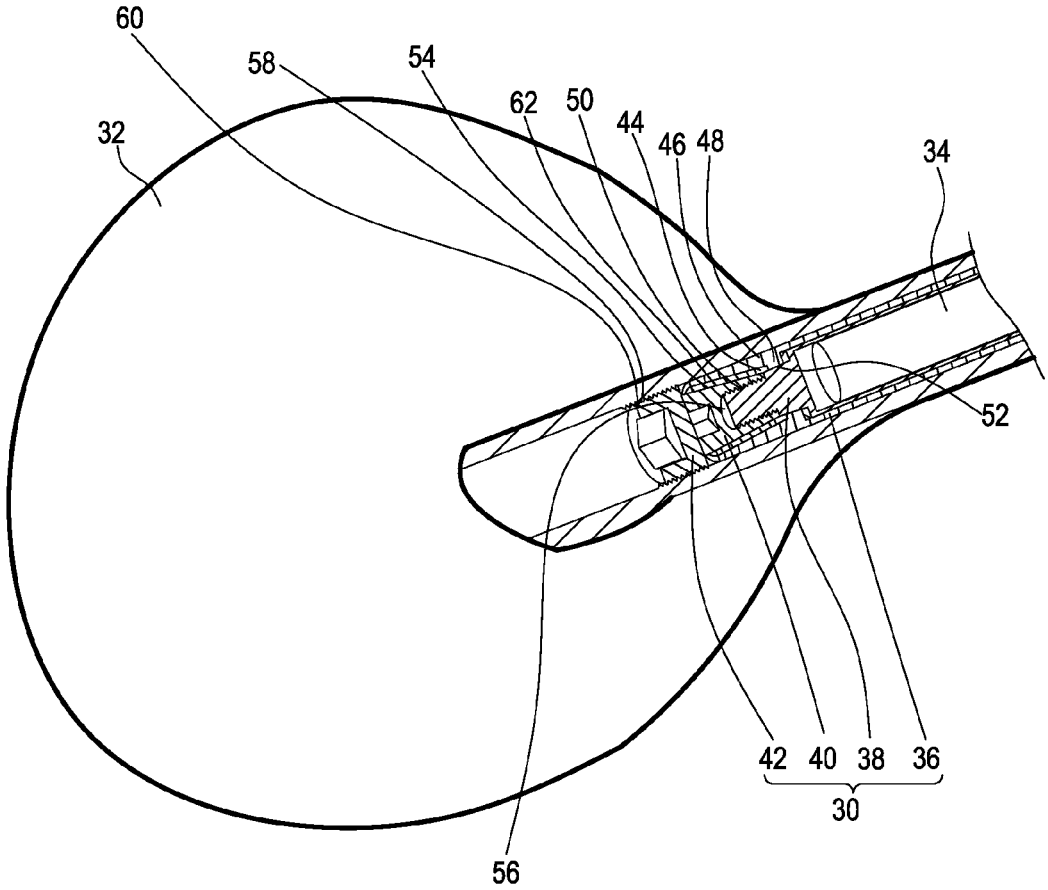
FIG. 3 is a cross-sectional view of connecting a club head with a shaft through the golf club interchanging connection structure according to the first embodiment of the present invention.

Referring to FIGS. 2 and 3, they are respectively an exploded view of a golf club interchanging connection structure according to a first embodiment of the present invention and a cross-sectional view of connecting a club head with a shaft through the golf club interchanging connection structure according to the first embodiment of the present invention. The golf club interchanging connection structure 30 in the first embodiment of the present invention is used to interchange a club head 32 and a shaft 34 of a golf club, which includes a positioning mechanism 36, a club sleeve 38, an internal screw 40, and an anti-rotation external screw 42.

The positioning mechanism 36 is fixed in the club head 32 by bonding or welding. One end in the positioning mechanism 36 includes a tapered slot 44 and a flange 46. One end of the tapered slot 44 with a smaller inner diameter is formed into the flange 46 in the positioning mechanism 36. Furthermore, the flange 46 could include at least one positioning block 48 on an inner side thereof.

One end of the club sleeve 38 is connected to and fixed with the shaft 34, and the other end has a first male screw 50. The club sleeve 38 is placed into the positioning mechanism 36, and leans against the flange 46. Furthermore, the club sleeve 38 could include at least one positioning slot 52 corresponding to the positioning block 48, and the positioning slot 52 must correspond to the positioning block 48 for positioning and fixing the club sleeve 38.

The external portion of the internal screw 40 is configured into a tapered shape 54 corresponding to the tapered slot 44 of the positioning mechanism 36, and one end of the internal screw 40 with a smaller outer diameter includes a nut hole 56. The nut hole 56 of the internal screw 40 is screwed with the first male screw 50 of the club sleeve 38, so as to lock the shaft 34 connected to the club sleeve 38.

The anti-rotation external screw 42 is made of, for example, iron, stainless steel, pure titanium, titanium alloy, aluminum, or aluminum alloy, and it comprises a second male screw 58 on an outer surface thereof corresponding to a female screw 60 in the club head 32. The second male screw 58 of the anti-rotation external screw 42 is screwed with the female screw 60, and the anti-rotation external screw 42 leans against the internal screw 40, so as to prevent the internal screw 40 from coming loose after the golf club has been utilized to hit the ball again and again.

It should be noted that, in the first embodiment of the present invention, the tapered slot 44 in the positioning mechanism 36 and the internal screw 40 are designed as tapered shape for enhancing the rotation-resistant effect between the positioning mechanism 36 and the internal screw 40, and the golf club interchanging connection structure 30 could further include a tapered gasket 62 placed between the internal screw 40 configured into the tapered shape 54 and the tapered slot 44 of the positioning mechanism 36. Once the internal screw 40 is firmly screwed, the tapered gasket 62 provides a rotation-resistant force for the shaft 34 and the club head 32. However, in other embodiments, the interior of the positioning mechanism and the internal screw are not constricted to be designed as tapered shape.

Figure 4:
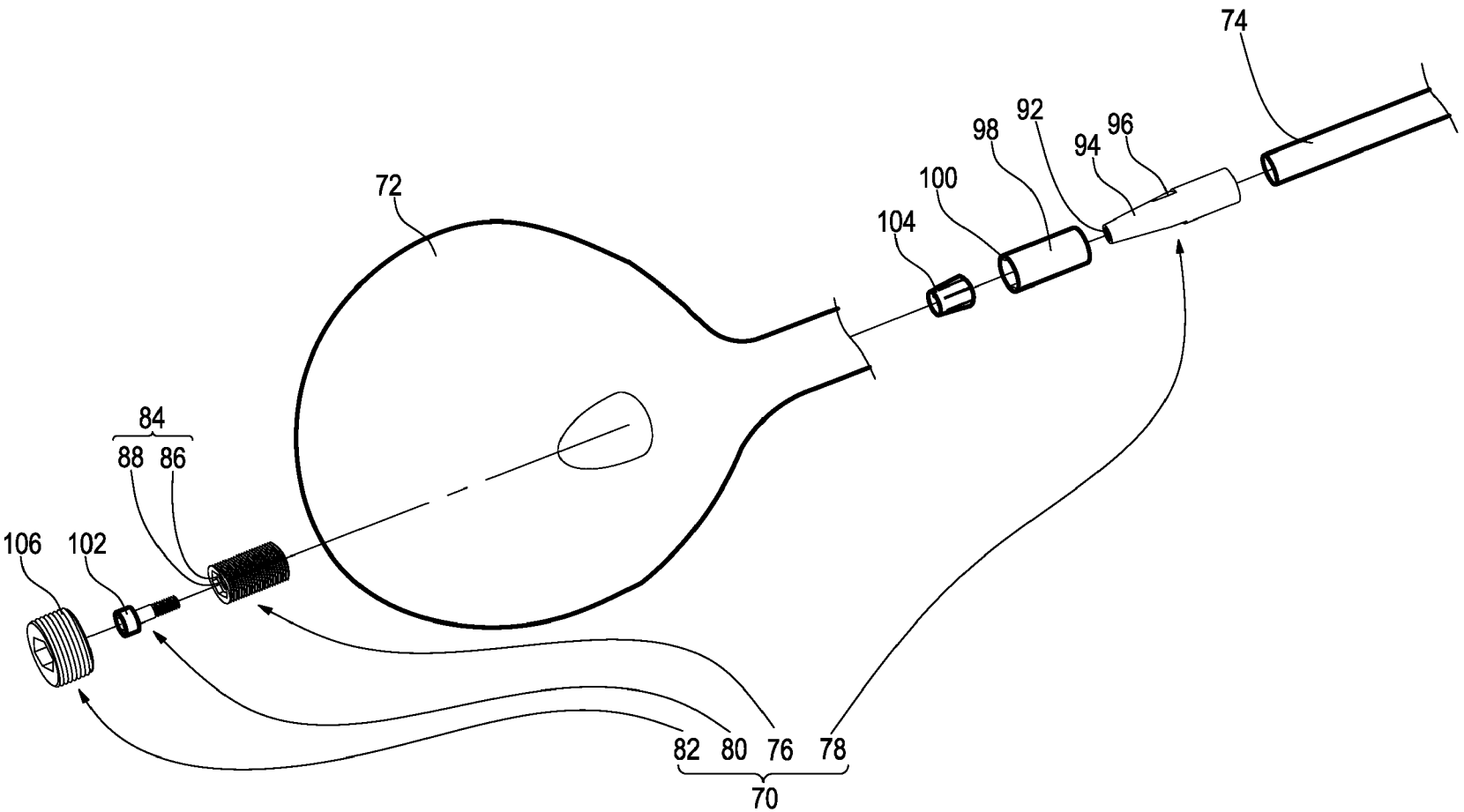
FIG. 4 is an exploded view of a golf club interchanging connection structure according to a second embodiment of the present invention.
Figure 5:
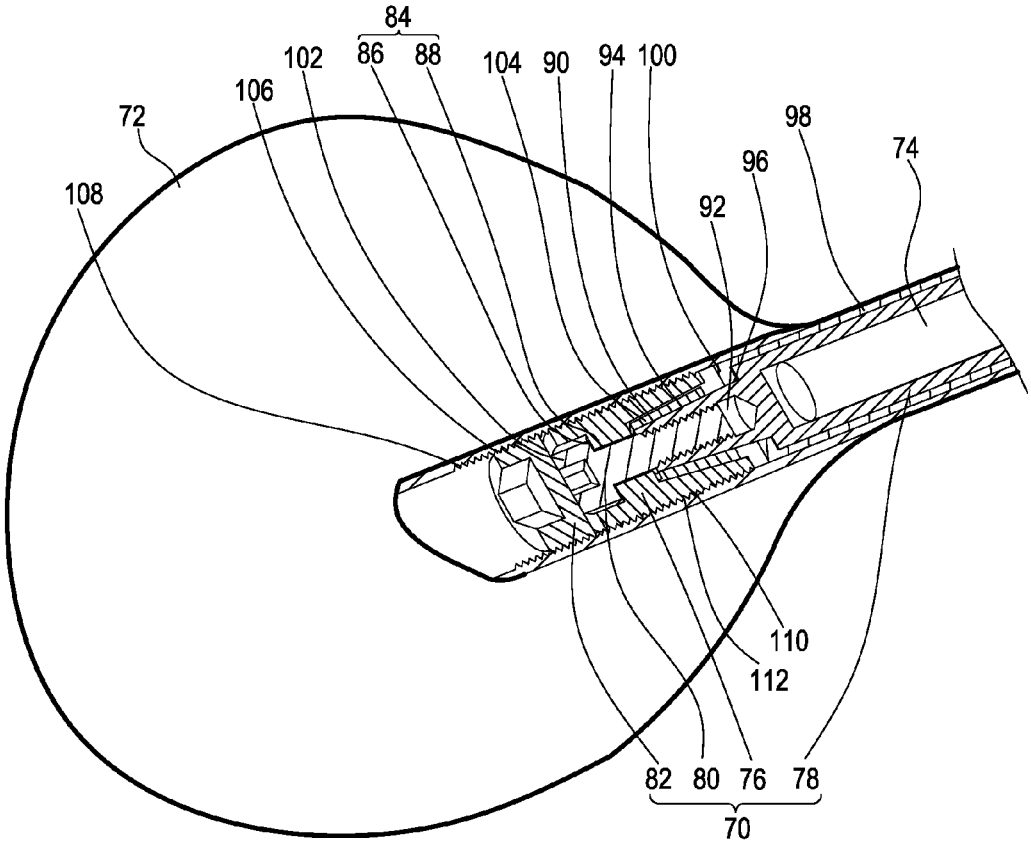
FIG. 5 is a cross-sectional view of connecting a club head with a shaft through the golf club interchanging connection structure according to the second embodiment of the present invention.

Referring to FIGS. 4 and 5, they are respectively an exploded view of a golf club interchanging connection structure according to a second embodiment of the present invention and a cross-sectional view of connecting a club head with a shaft through the golf club interchanging connection structure according to the second embodiment of the present invention. The golf club interchanging connection structure 70 in the second embodiment of the present invention is used to interchange a club head 72 and a shaft 74 of a golf club, which includes a tube seat 76, a club sleeve 78, an internal screw 80, and an anti-rotation external screw 82.

The tube seat 76 may be integrally formed with the club head 72 or may be jointed and disposed in the club head 72, which includes a flange 84. The flange 84 includes a leaning surface 86 and a positioning hole 88 located in the leaning surface 86. In the second embodiment of the present invention, the tube seat 76 could further include a tapered slot 90 located in the tube seat 76, and the inner diameter of one end of the tapered slot 90 close to the flange 84 is smaller than that of the other end away from the flange 84.

The club sleeve 78 is place within the tube seat 76, and has one end being connected to and fixed with the shaft 74 and the other end having a nut hole 92. In the second embodiment of the present invention, the end of the club sleeve 78 having the nut hole 92 is configured into a tapered shape 94 corresponding to the tapered slot 90 in the tube seat 76, and the club sleeve 78 further has at least one positioning slot 96 on the external portion thereof. Furthermore, the golf club interchanging connection structure 70 in the second embodiment of the present invention could further include a positioning mechanism 98 located in the club head 72, and the positioning mechanism 98 includes at least one positioning block 100 corresponding to the positioning slot 96 of the club sleeve 78. When the club sleeve 78 is placed into the club head 72, the positioning slot 96 of the club sleeve 78 must correspond to the positioning block 100 for positioning and fixing the club sleeve 78.

The internal screw 80 has a screw head 102, and it is positioned through the positioning hole 88, and screwed with the nut hole 92 of the club sleeve 78. The screw head 102 leans against the leaning surface 86, so as to lock the shaft 74 connected to the club sleeve 78. Furthermore, the golf club interchanging connection structure 70 in the second embodiment of the present invention could further include a tapered gasket 104 placed between the end of the club sleeve 78 configured into the tapered shape 94 and the tapered slot 90 of the tube seat 76. Once the internal screw 80 is firmly screwed, the tapered gasket 104 provides a rotation-resistant force for the shaft 74 and the club head 72.

The anti-rotation external screw 82 comprises a first male screw 106 on an outer surface thereof corresponding to a first female screw 108 in the club head 72. The first male screw 106 of the anti-rotation external screw 82 is screwed with the first female screw 108, and the anti-rotation external screw 82 leans against the screw head 102 of the internal screw 80, so as to prevent the internal screw 80 from coming loose after the golf club has been utilized to hit the ball again and again. Therein, the first female screw 108 is formed in the club head 72 or the tube seat 76.

It should be noted that, in the second embodiment of the present invention, the tube seat 76 could include a second male screw 110 on an outer surface thereof, and it is placed into the club head 72 with the second male screw 110 being screwed with a second female screw 112 in the club head 72.

As compared with the conventional art, in the golf club interchanging connection structure of the present invention, the anti-rotation external screw is utilized to lean against the internal screw, which is helpful for preventing the internal screw from coming loose and then influencing the fixing effect of the club head and the shaft after the golf club has been utilized to hit the ball again and again. Furthermore, the golf club interchanging connection structure of the present invention prevents the club head from departing from the shaft due to the loose screw, so as to prevent the risk of hurting people.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A golf club interchanging connection structure, for interchanging a club head and a shaft of a golf club, comprising:

a tube seat, disposed in the club head, and comprising a flange, wherein the flange includes a leaning surface and a positioning hole located in the leaning surface, and a tapered slot, located in the tube seat, wherein its inner diameter of one end close to the flange is smaller than that of an other end away from the flange;

a club sleeve, placed within the tube seat, and having one end being connected to and fixed with the shaft and the other end having a nut hole, wherein the end having the nut hole of the club sleeve is configured into a tapered shape corresponding to the tapered slot in the tube seat;

an internal screw, comprising a screw head, wherein the internal screw is positioned through the positioning hole and screwed with the nut hole of the club sleeve, and the screw head leans against the leaning surface to lock the shaft connected to the club sleeve;

an anti-rotation external screw, having a first male screw on an outer surface of the anti-rotation external screw corresponding to a first female screw in the club head, wherein the first male screw of the anti-rotation external screw is screwed with the first female screw, and the anti-rotation external screw leans against the screw head of the internal screw; and a tapered gasket placed between the tapered end of the club sleeve and the tapered slot of the tube seat.

2. The golf club interchanging connection structure as claimed in claim 1, further comprising a positioning mechanism placed within the club head, wherein the positioning mechanism includes at least one positioning block corresponding to at least one positioning slot on an external portion of the club sleeve, and when the club sleeve is placed into the club head, the positioning slot of the club sleeve corresponds to the positioning block for positioning and fixing the club sleeve.

* * * * *